US005380080A

United States Patent [19]

Rubin et al.

[11] Patent Number: 5,380,080

[45] Date of Patent: Jan. 10, 1995

[54] REFLECTION-AUGMENTING DISPLAY CASE

[75] Inventors: Robert I. Rubin, St. Louis; Wayne P. Drewes, Creve Coeur; Jean Boelhauf, Woodson Terrace, all of Mo.

[73] Assignee: Jewelry Works, Inc., St. Louis, Mo.

[21] Appl. No.: 69,533

[22] Filed: Jun. 1, 1993

[51] Int. Cl.[6] ..... A47F 3/06

[52] U.S. Cl. ..... 312/128; 312/138.1; 312/227

[58] Field of Search ..... 312/224, 227, 114, 128, 312/138.1

[56] References Cited

U.S. PATENT DOCUMENTS

| | | | |
|---|---|---|---|
| 201,756 | 3/1878 | Dealy | 312/114 |
| 747,442 | 2/1903 | Latshaw | 312/128 X |
| 1,076,501 | 10/1913 | Kress | 312/114 |
| 1,644,675 | 10/1927 | Huening | 312/114 |
| 1,850,417 | 3/1932 | Sanders | 312/114 X |
| 2,049,594 | 8/1936 | Stultz | 312/128 |
| 2,074,870 | 3/1937 | Starr et al. | 312/138.1 |
| 2,320,556 | 6/1943 | Belshaw | 312/171 |
| 2,567,388 | 9/1951 | Long | 312/114 |
| 3,032,905 | 5/1962 | Schultz | 40/133 |
| 3,334,952 | 8/1967 | Brach | 312/224 |
| 4,132,456 | 1/1979 | Lewis | 312/223 |
| 4,706,821 | 11/1987 | Kohls et al. | 312/114 X |

*Primary Examiner*—Richard E. Gluck

*Attorney, Agent, or Firm*—Jerome A. Gross

[57] ABSTRACT

A display case for reflective articles includes a base preferably having upward-sloping side edges and a transparent enclosure. Within the enclosure is an upward-and-aft sloping display ramp. A downward-and-aft sloping mirror extends from the top of the enclosure at least to the level of the top edge of the ramp. This mirror may be the forward surface of a rear wall of the enclosure. Viewers both at a substantial distance from and close to and above the case will see not only the articles displayed on the ramp, but also at least portions of their reflections in the mirrored surfaces. The mirror also serves to reflect some ambient lighting onto the display ramp.

4 Claims, 2 Drawing Sheets

REFLECTION-AUGMENTING DISPLAY CASE

CROSS-REFERENCE TO RELATED APPLICATIONS

Application for Design Patent by same applicants filed on Apr. 12, 1993 (Serial Number not yet issued) entitled "Reflective Jewelry Display Case", includes subject matter also included in this application.

SUMMARY OF THE INVENTION

This invention relates to display cases for reflective articles such as jewelry.

The object of the present invention is to so display and reflect the displayed articles as to attract viewers, both from substantially forward of the display case and directly adjacent to and above the display level by augmenting the reflectivity of the displayed articles by mirror images of at least part of such articles.

An enclosure having transparent forward, top and side surfaces is so supported by a base, whose side edges preferably have a gentle rearward-and-upward slope, that a mirrored rear panel or panels (preferably mirrored sliding doors perpendicular to the upward sloping side edges), slope upward-and-forward relative to vertical. Alternately a similarly slanted mirrored surface may be forward of a rear surface of the enclosure.

Within the enclosure, supported by the base, is a display ramp, preferably covered with a relatively non-reflective material such as black velvet. The ramp slopes upward-and-aft in a direction which, if extended, would intersect the plane of the mirrored surface at an obtuse angle to that part of the mirrored surface extending thereabove.

The upward-and-aft slope of the ramp is such that, when a number of small reflective articles such as jewelry are displayed at various levels thereon, those articles aft and higher on the ramp will be seen even at a substantial distance forward of the display case, as will also their reflections in the mirrored rear wall; however, due to the obtuse angle between the ramp and the mirrored surface, reflections from it are also evident to prospective customers viewing both from substantial distances and close to and above the case, and even to the sides thereof.

As compared with a customary display case having a horizontal display surface and a vertical mirrored surface perpendicular to the display surface, the present ramp and mirror arrangement provides the customer with both a direct and a reflected view of the displayed articles, even from a substantial distance. The present case also tends to reflect downward onto the displayed articles the ambient light coming substantially from above and in front of the case.

DESCRIPTION OF THE PREFERRED EMBODIMENT

Figure 1:
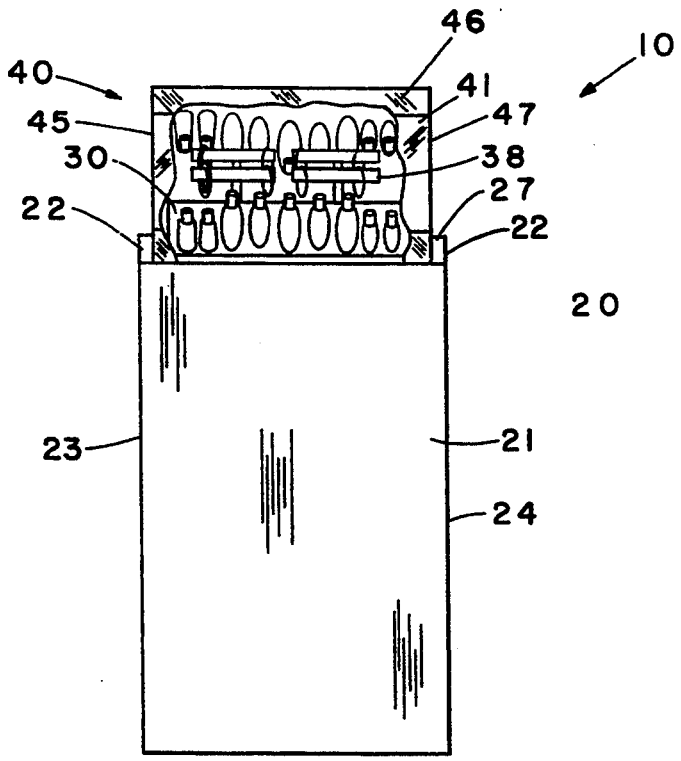
FIG. 1 is a front elevation view of a display case embodying the present invention with frontal surfaces of its transparent enclosure partly broken away to show reflective articles and partial reflections thereof.
Figure 2:
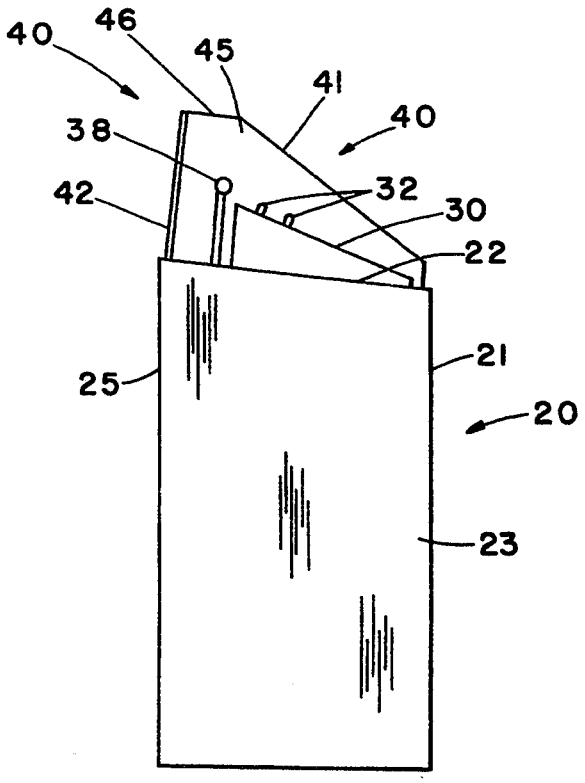
FIG. 2 is a side elevation view of the left side of said display case.
Figure 5:
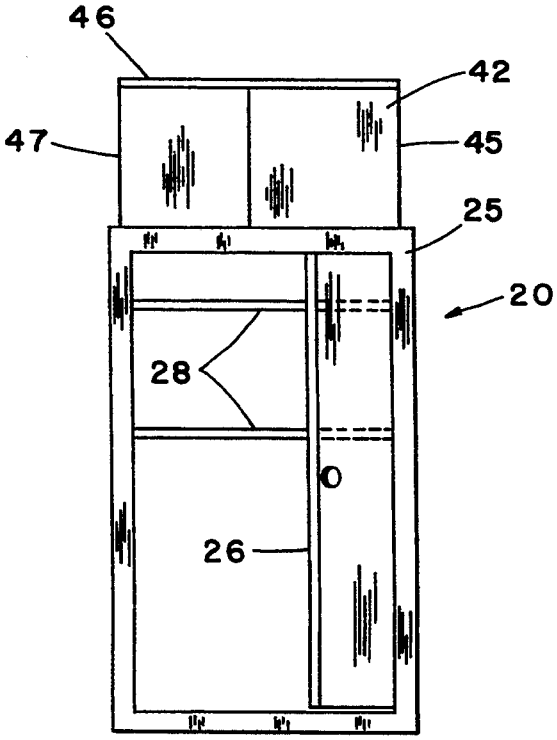
FIG. 5 is a rear view of said display case, showing an opened rear door in the base thereof.

Referring to the figures, the display case 10 of the present invention generally comprises a base, generally designated 20, having side edges 22 which slope upward-and-aft, a display ramp 30, mirrored rear surface panel or panels 42, and a transparent enclosure generally designated 40, resting on the side edges 22 and covering the display ramp 30 and the articles displayed. The base 20 is shown in FIGS. 1, 2 and 5 to have a front wall 21, a back wall 25 (which, as seen in FIG. 5 may contain an openable door 26), a left side wall 23, a right side wall 24, and side edges 22. The base 20 has a top 27 on which may rest a display ramp 30. The side edges 22 serve to support mirrored rear surface panel or panels 42, hereafter described, and the transparent enclosure 40. The base 20 preferably is of a height to present the articles in the display case 10 to customers at or above approximately waist height.

The aft side of the base 20 has a rectangular edge 25 within which is mounted a door 26 as shown in FIG. 5 to provide access to the interior. One or more shelves 28 may be provided inside the base 20, as shown in FIG. 5.

Preferably, the side edges 22 and top 27 of the base 20 slope upward-and-aft, permitting the mirrored rear surface panel or panels 42 to be perpendicular to the top 27 as hereafter described. As an alternative, the top 27 may be horizontal with side edges only sloping upward-and-aft.

Resting on the base top 27 is an upward-and-aft sloping display ramp 30 which may take up a portion only of the space provided inside the enclosure 40, leaving space between the display ramp 30 and the mirrored rear surface panel or panels 42 to insert a rack or support 38 for various types of jewelry such as bracelets.

The angle of the ramp up-slope may be from 10° to 40° from horizontal, preferably about 24° from horizontal, including any up-slope angle of the base top 27. The viewing surface of the display ramp 30 is preferably covered with some non-reflective material such as black velvet in order to provide flattering contrast with the jewelry or other reflective articles displayed thereon.

Figure 3:
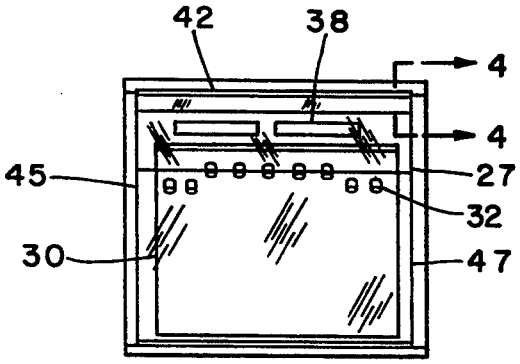
FIG. 3 is a top view thereof.

The display ramp 30 may be provided with one or more velvet-covered projections 32, as shown in FIGS. 2 and 3, to hold necklaces or other articles displayed in the case 10 in positions attractive to the viewing customers. Such projections 32 may be seen in FIG. 1. The up-slope of the display ramp 30 allows articles displayed thereon to be viewed by customers both at some distance and from positions close to the case 10.

The transparent enclosure 40, formed as shown in FIGS. 1, 2 and 3 comprises a forward surface 41, a left side 45, a right side 47, and an openable rear wall 42, preferably the mirrored-surface panels 42, hereafter discussed. The enclosure forward surface 41 may be partially sloping as shown in FIG. 2 for easy viewing of the articles displayed. If desired, the enclosure 40 may be openable but provided with locking apparatus to secure it to the base 20.

Positioned behind the display ramp 30, and a bracelet rack 38, if one is present, is an angled mirrored surface panel or panels 42, which preferably serve as the rear wall for the enclosure 40. The slope of the mirrored surface panel or panels 42 is anywhere from 5° to 30° downward-and-aft from vertical, but preferably about 8°. When both the display ramp 30 and the mirrored surface panel or panels 42 are positioned at their respective preferred slopes, an obtuse angle of about 106° will be formed between them.

Figure 4:
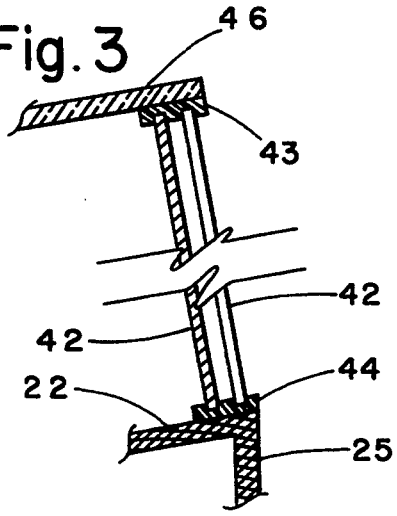
FIG. 4 is an enlarged partial cross-sectional view as seen along lines 4—4 of FIG. 3.

When the mirrored surface panel or panels 42 serve as The rear wall of the enclosure 40, they may, as shown in FIG. 4, be two parts mounted in the closely spaced parallel tracks of an upper channel 43 and a lower channel 44 (both preferably molded of plastic), to operate as sliding panels to provide access into the interior of the enclosure 40. The upper channel 43 is attached to the underside of the enclosure top 46 and the lower channel 44 to the rear edge of the base 20, as seen in enlarge FIG. 4, in which the panels 42 are positioned at the same angle downward-and-aft from vertical as the side edges 22 are upward-and-aft from horizontal.

It is an important aspect of this invention that the slopes of the display ramp 30 and the panel mirrored surface 42, relative to each other and to the viewing customer, allow simultaneous viewing of the articles themselves (on the display ramp 30) and the reflection of the same articles (in the mirrored panel surface 42). This reflection of the jewelry displayed promotes customer interest and tends to increase the likelihood of purchase.

Various modifications may be made in the apparatus herein described without departing from the scope of the invention; accordingly, all matter contained in the foregoing description shall be taken as illustrative rather than limiting.

We claim:

1. A display case for a plurality of light-reflective articles, comprising:

a base, a display ramp upon and supported by said base and sloping upward-and-aft, whereby those articles positioned thereon aft of others will be at a level higher than articles forward thereof, a downward-and-aft sloping mirrored surface extending from a level higher than the highest portion of said ramp and downward to at least partly aft of said display ramp, and the ramp up-slope from horizontal is at an angle of 18° to 30° and the downward-and-aft slope of the mirrored surface is at an angle of 5° to 12° from vertical, an enclosure for said display ramp and said mirrored surface, said enclosure having transparent forward and top surfaces, whereby at least parts of light-reflective articles displayed on said ramp will be so reflected in said mirrored surface that both the displayed articles and their mirror reflections are simultaneously visible from above and in front of said ramp.

2. A display case as defined in claim 1, wherein the downward-and-aft sloping mirrored surface is the forward surface of an openable rear wall portion of said enclosure.

3. A display case as defined in claim 2, wherein said base includes side edges sloping rearward-and-upward from horizontal at an angle substantially equal to that of the downward-and-aft slope of said rear wall portion, whereby said rear wall portion is substantially perpendicular to the side edges of said base.

4. A display case as defined in claim 1, wherein the angle of downward-and-aft slope of said mirrored surface is such as to reflect at least part of ambient lighting down onto said ramp.

* * * * *